United States Patent [19]

Jönsson

[11] Patent Number: 4,916,359

[45] Date of Patent: Apr. 10, 1990

[54] GAS DISCHARGE LAMP ENVELOPE COMPRISING A BARIUM SULPHATE PROTECTIVE LAYER DISPOSED ON ITS INNER SURFACE

[75] Inventor: Günther Jönsson, Karlskrona, Sweden

[73] Assignee: Lumalampan Aktiebolag, Sweden

[21] Appl. No.: 181,075

[22] Filed: Apr. 13, 1988

[30] Foreign Application Priority Data

Apr. 27, 1987 [SE] Sweden ..... 8701724

[51] Int. Cl.[4] ..... H01J 61/35

[52] U.S. Cl. ..... 313/489; 313/635

[58] Field of Search ..... 313/489, 635

[56] References Cited

U.S. PATENT DOCUMENTS

| | | | |
|---|---|---|---|
| 2,299,720 | 10/1942 | Holman | 313/489 |
| 2,838,707 | 6/1958 | Schwing et al. | 313/489 |
| 3,541,377 | 11/1970 | Nagy | 313/489 |
| 3,617,357 | 11/1971 | Nagy | 313/489 |

FOREIGN PATENT DOCUMENTS

| | | | |
|---|---|---|---|
| 550704 | 4/1973 | Sweden | 313/489 |

*Primary Examiner*—Donald J. Yusko
*Assistant Examiner*—Michael Horabik
*Attorney, Agent, or Firm*—Roylance, Abrams, Berdo & Goodman

[57] ABSTRACT

A protective layer of $BaSO_4$ or $BaSO_4$ mixed with $SiO_2$ is applied in suspension to the inner surface of the glass discharge tube or envelope of a gas discharge lamp of the metal vapour type. The protective layer prevents contact, e.g., of mercury in the discharge chamber with amalgam-forming substances present in the glass surface of the lamp discharge tube. In addition, the crystals of the protective layer re-reflect shortwave ultraviolet radiation back to the layer of luminescent substance, thereby to generate visible light and increasing the efficiency of the lamp. The protective layer results in a marked decrease in the prior art's accepted reduction in the lamp luminance in relation to lamp burning time.

11 Claims, 2 Drawing Sheets

GAS DISCHARGE LAMP ENVELOPE COMPRISING A BARIUM SULPHATE PROTECTIVE LAYER DISPOSED ON ITS INNER SURFACE

FIELD OF THE INVENTION

The present invention relates to discharge lamps of the metal vapour type, for example, the invention relates to a fluorescent lamp which comprises a tubular glass envelope or discharge tube which has an electrode fused into each end thereof and in which a positive column is generated between the electrodes by an electric discharge. This causes the metal vapour ions in said column to become excited and to transmit ultraviolet light. The internal surface of the discharge tube is provided with a barrier coating as protection against the ultraviolet light which penetrates the fluorescent, or luminescent, coating applied to the internal surfaces of the tube.

BACKGROUND

It is well known that the useful light output of a discharge lamp will diminish progressively in relation to the number of hours that the lamp has been in operation, i.e. burning time, this relationship being sometimes referred to as the lumen maintenance. It is evident from tests carried out in this regard that lamp luminescence is affected negatively as a result of interactions that take place between the substances incorporated in the glass surface of the discharge tube, the luminescent powder granules, the mercury, the electrode devices, and gaseous contaminants in the lamp atmosphere, e.g. gaseous nitrogen, carbon monoxide gas, carbon dioxide, water, and hydrocarbons. These interactions may possibly result in chemical reactions which:

- reduce the physical efficiency of the luminescent powder;
- lessen the ability of the discharge tube to allow visible light to pass through; and
- contaminate the lamp atmosphere and thereby negatively influence the light characteristics of the lamp and its length of useful light.

A discharge lamp, such as a fluorescent lamp, in which the discharge tube or glass envelope is made of soda glass and contains mercury, fluorescent powder, emission substance, a noble-gas fill and diverse gaseous contaminants, constitutes a highly reactive system, from a chemical viewpoint. The chemical reactants engendered through the discharge mechanism thus take part in many different reaction processes and often influence the speed and the state of equilibrium of these processes. The transition to discharge tubes of smaller diameter that has taken place in recent years has resulted in an increase in the wall load of such tubes per unit of glass area. In this way the proportion of energy-rich ultraviolet light generated (wavelength=185 nonometers, nm) has increased in relation to the excitation radiation (wavelength=254 nm). This higher density of UV-185 nm—which is a consequence of the high electron temperature in the plasma formed by the positive column extending between the anode and cathode of the discharge tube—results in greater occurrence of energy-rich chemical reactants.

Consequently, in the manufacture of discharge tubes, or glass envelopes, of progressively decreasing diameters progressively higher demands are placed on lamp construction with regard to the choice of those components which can be expected to be subjected to chemical attack as a result of the comparatively high UV-intensity. In the case of lamps such as these, inter alia, the mercury atoms—when excited to a level of $6^1P_1$ (6.7 eV)—constitute a threat to certain luminenscent powders when the crystal lattice, or activator centres, of such powders incorporate cations which have an electronegativity greater than 1.5 Pauling units. As is well known, excited mercury atoms will react with oxygen atoms already at room temperature, in accordance with the formula:

$$Hg^*(g) + \tfrac{1}{2}O_2(g) \longrightarrow HgO(s)$$

The reaction product is thus mercury oxide which condenses in the form of a colored light-absorbent coating on various parts of the lamp discharge chamber, primarily on the layer of luminescent powder present in the area around the Faraday dark space, where the presence of positive and negative charge carriers is relatively high (inter alia $Hg^+$, $Hg_2^{30}$, $O^{--}$).

Another factor which is liable to lower the luminescence of a lamp is the interaction of the UV-radiation and the reaction of the Hg-atoms with the substances incorporated in the glass surface of the discharge tube. It is well known that different compositions of glass have different degrees of sensitivity to radiation which is rich in energy. This phenomenon is called solarization and is the effect of photochemically initiated redox reactions (electron transfers) between the types of atoms present in the glass, often metal ions in an oxide. These photochemical processes often lead to a change in color of the glass (discoloration) with a subsequent reduction in permeability to visible light. The interaction of UV-radiation with glass can, in some cases, also cause mercury atoms to become involved secondarily in a process which produces other light absorbing compounds, such as HgS for instance.

During the years in which the development of mercury discharge lamps has progressed, a number of papers have been published. The problems associated with the reaction of mercury with amalgam-forming atoms incorporated in the glass discharge tube and with the light absorbing properties of the resultant reaction products have been discussed in these papers.

The extent to which amalgam is formed during the various stages of the useful life of the lamp depends greatly on the composition of the glass from which the lamp envelope is made and on the condition of the surface of the glass. The glass surface may be activated with amalgam-forming reactants by diffusion of alkali from internal parts of the glass even in the manufacturing stage of the lamp, when the binder present in the luminescent powder layer is baked off in a furnace at ca 600° C. The formation of alkali amalgams which are colored to greater or lesser degrees, e.g. $Na_nHg_m$(n,m=1−8), is considered to be one of the reasons for abnormal light losses.

Since the risk of photochemical reactions (solarization) and of the formation of amalgam becomes greater with decreasing tube diameters (higher wall loading per unit of area), it is desirous to hold the reactants separated to the greatest possible extent. Those luminescent powders which are adapted for optimum light emission, e.g. luminescents of the 3-band kind, will not normally fulfill the requirements placed on an effective barrier against such amalgam formation. The most suitable particle size distribution for maximum light generation is such (2–8 micro-meters) that the powder layer is relatively porous and therewith forms a poor mechanical barrier against mercury vapour. In addition hereto UV-185 nm is reflected badly by the relatively coarse particles of luminescent powder and will pass essentially therethrough, since absorption of this energy-rich radiation is low. Consequently, approximately 50% of the UV-185-radiation reaches the glass surface of the lamp envelope, where it is able to initiate various chemical or photochemical processes.

DISCUSSION OF THE PRIOR ART

The efficiency of a discharge tube, i.e. the quantity of light emitted in relation to the energy consumed, is highly contingent on the luminenscent powder coating. If light is to be generated as effectively as possible, the powder crystals must have the requisite shape and size. Research has shown in this regard that the best result is achieved when the crystals have the form of platelets ($5\times20\times2$ micro-meters). The efficiency of the luminescent powder coating, however, depends greatly on the thickness of the coating. When the coating is too thin, not all of the UV-radiation will be converted to visible light. On the other hand, the crystals of an excessively thick coating will "shade" one another. The ideal thickness is considered to be one which is equal to 3 to 4 layers of crystals of the aforesaid kind and size.

It is also known that the luminance of gas discharge lamps containing luminescent powder coatings of a given chemical composition can be impaired quite drastically by reactions which take place between the substances present in the glass envelope and the luminescent powder coating. A barrier between the glass envelope, or discharge tube, and the coating of luminescent powder which is stable against chemical attack and UV-radiation will afford good protection against these light-impairing reactions.

A method for coating a discharge tube with such a barrier, or protective layer, is described in DD 229 247. According to this publication, the internal surfaces of a discharge tube, or glass envelope, are coated with a layer of silicon dioxide ($SiO_2$) through the medium of an aqueous suspension.

SE 8405741-3 teaches a barrier layer which reduces the risk of the luminescent substance entering the glass surface of a discharge tube, thereby causing the tube to become brittle during the repeated heat treatment to which the tube is subjected during its manufacture. The barrier layer is reported to comprise a colorless metal oxide, of which alumina, silica and titanium oxide are said to be examples. According to U.S. Pat. No. 3,544,828, such a protective barrier may comprise polyorganosiloxane.

SUMMARY OF THE INVENTION

A main object of the present invention is to provide, in the case of mercury discharge lamps, a barrier layer or protective layer which will effectively prevent mercury from reacting with amalgam-producing alkali metals present in the glass of the lamp discharge tube or envelope. Another object is to provide such a protective layer which will prevent the occurrence of photochemical reactions between the substances found in the luminescent substance and the glass constituents. This will minimize the reduction in light emission, or luminance, during the useful life of the lamp. Also, the protective layer assists in converting ultraviolet radiation to visible light as effectively as possible, particularly in the case of luminescent powder coatings of relatively narrow particle size distribution. The protective layer is also intended to prevent such reactions as those which can lead to solarization, i.e. the oxidation or reduction of ions in the surface of the glass discharge tube or envelope such as to form colored products which themselves will absorb some of the wavelengths of visible light.

Thus, the combined objects of the present invention include a gas discharge lamp that will not suffer the reduction in light emission suffered by conventional gas discharge lamps.

Long term tests carried out on gas discharge lamps fitted with discharge tubes according to the invention have shown that the decrease in light emission, or luminance, caused by aging of the luminescent substances used has been smaller than expected.

This is due to the reduced total reactivity of the system formed by the discharge chamber of the tube. This advantage enables excitation radiation reflected in the protective layer to be reflected a multiple of times in the luminescent powder layer, thereby utilizing the ultraviolet radiation to a high extent.

It is known that maximum light emission from a gas discharge lamp can only be achieved by fulfilling a number of mutually different parameters. One such parameter is the optimization of the luminescent powder layer with regard to particle size, fixation, surface weight, etc. Tests have been carried out to illustrate, with the aid of optical models, the propagation of the light generated in the luminescent powder layer. These tests have shown that only 35% of the light generated is radiated immediately and that 65% of said light is reflected within the lamp at least once, before exiting therefrom.

BRIEF DESCRIPTION OF THE DRAWINGS

The present invention will be more clearly understood with reference to the following detailed description and the drawings, which also form a part of this disclosure, and in which.

DETAILED DESCRIPTION

Figure 1A:
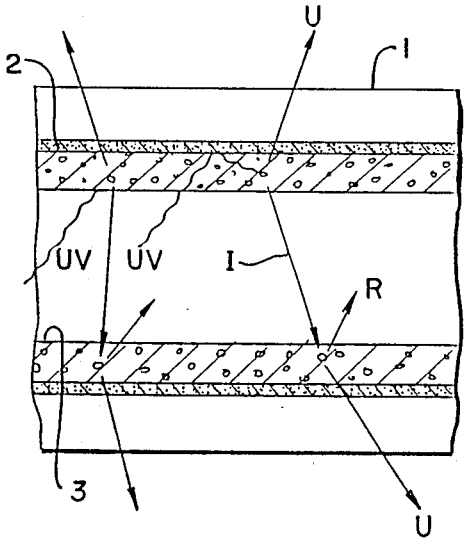
FIG. 1*a* is a cross-sectional schematic diagram of the gas discharge lamp tube of the present invention.
Figure 1B:
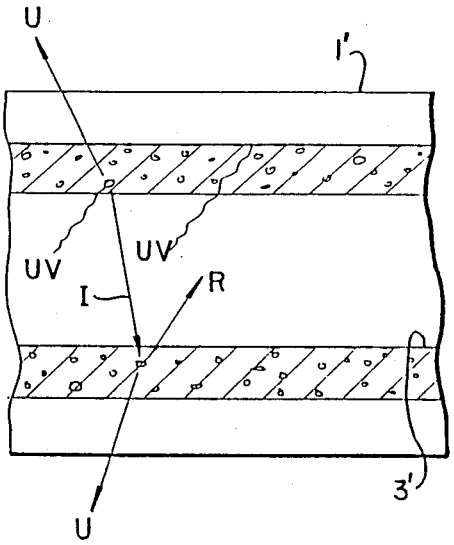
Fig. 1b PRIOR ART
FIG. 1*b* is a cross-sectional schematic diagram of a gas discharge lamp tube of the prior art.

FIGS. 1*a* and 1*b* illustrate a model of light generation and the propagation of light in a discharge tube provided with a protective layer (FIG. 1*a*) and a discharge tube not provided with a protective layer (FIG. 1*b*). In FIG. 1*a* the reference numeral 1 identifies the glass discharge tube or envelope, the reference numeral 2 identifies the protective layer, and the reference numeral 3 identifies the coating of luminescent powder. The arrows labelled I denote light which has penetrated the powder coating, the arrows labelled U denote light which radiates from the lamp, and the arrows labelled R denote reflected light. In FIG. 1*b* the reference numeral 1' identifies the glass discharge tube or envelope, and the reference numeral 3' identifies the coating of luminescent powder. The arrows labelled I denote light which has penetrated the powder coating, the arrows labelled U denote light which radiates from the lamp, and the arrows labelled R denote reflected light.

Figure 2:
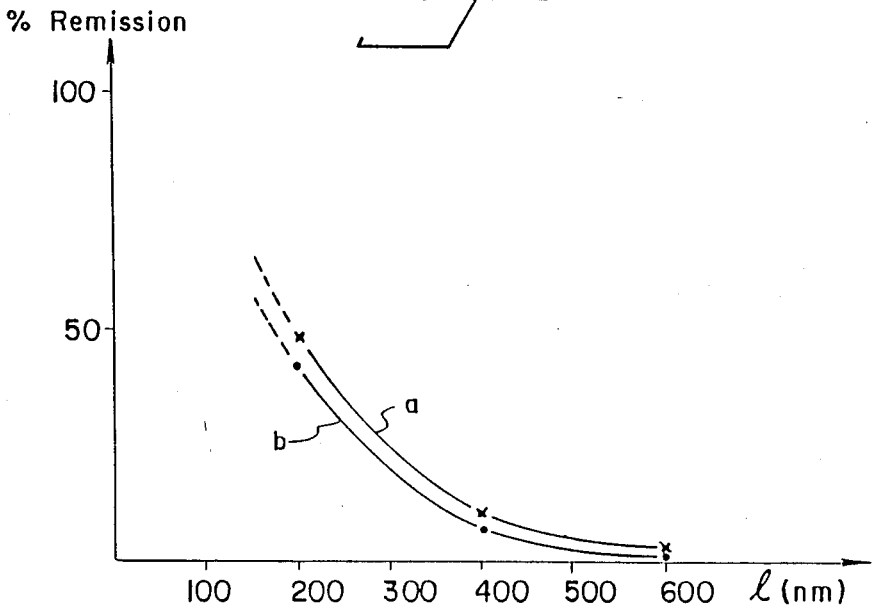
FIG. 2 is a graph showing the relationship between the wavelength of the light and the remission.

FIG. 2 is a graph which shows the relationship between the wavelength of the light and the remission, i.e. the diffuse particle-size dependency reflection. Each of the curves illustrates a different composition of the protective layer, namely, curve a is 0.1 $BaSO_4$+0.9 $SiO_2$ and curve b is all $BaSO_4$.

Figure 3:
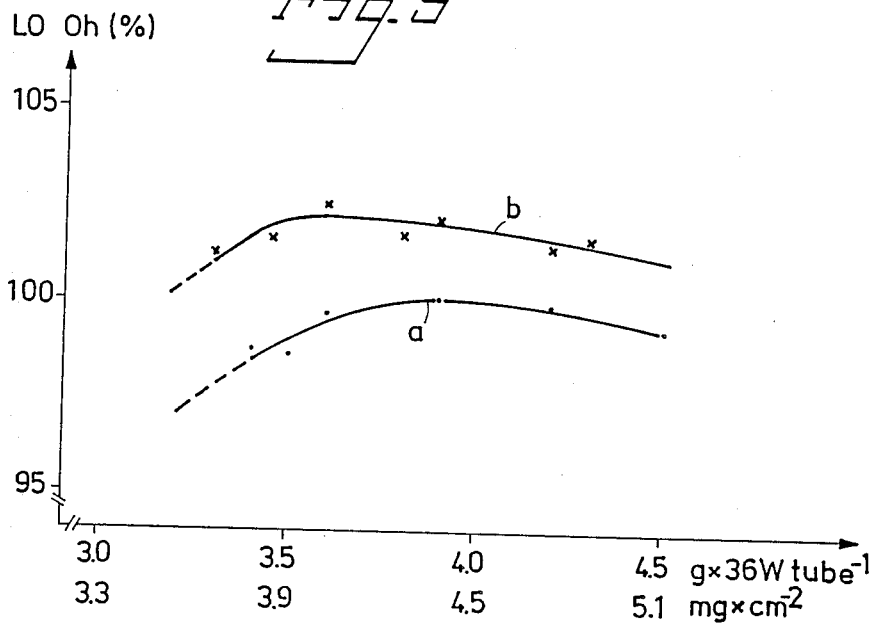
FIG. 3 is a graph showing the lumen value (LO) in percent at zero hours burning time as a function of the luminescent powder mass (g/36 W tube) or the mass per unit of area (mg/cm$^2$)

FIG. 3 shows the lumen value (LO) in percent at zero hours burning time as a function of the luminescent powder mass (g/36 W tube) or the mass per unit of area (mg/cm$^2$). It will be seen from this Figure that the maximum lumen value for discharge tubes which are provided with a protective layer of barium sulphate or barium sulphate and silicon dioxide according to the invention (curve b) is displaced towards the luminescent powder of lower layer weight. The inclusion of a protective layer enables the lumen value (LO) to be increased by about 2.0% with a layer weight which is about 10% lower than the surface weight in the reference tubes which lacks the provision of a protective layer (curve a).

Looking at FIG. 3 another way, the invention provides increased lumen value for the same mass of luminescent powder.

Figure 4:
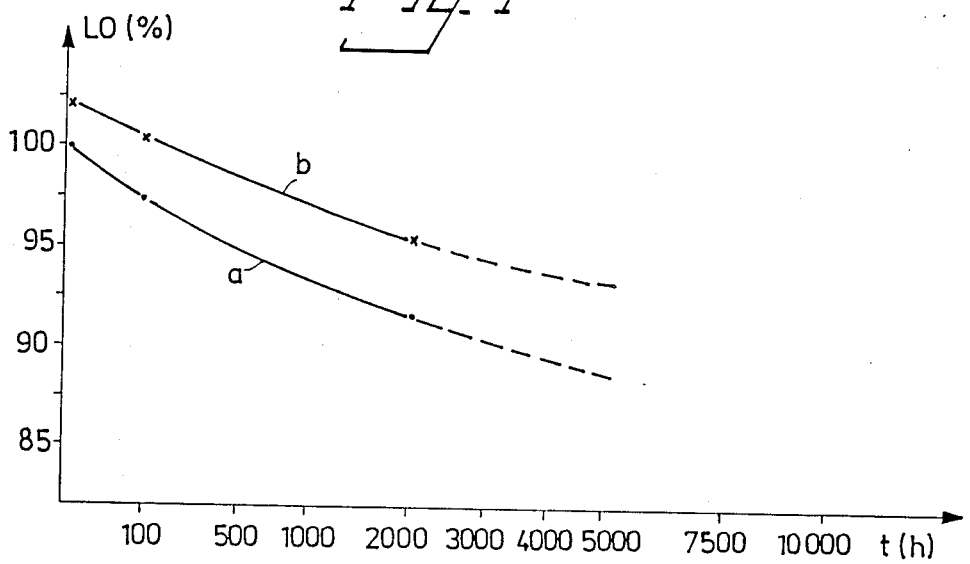
FIG. 4 is a graph showing the decrease in luminance of a 36 W-tube which lacks a protective layer (curve a) and a 36 W-tube which is provided with a protective layer (curve b).

FIG. 4 illustrates the decrease in luminance of a 36 W-tube which lacks a protective layer (curve a) and a 36 W-tube which is provided with a protective layer (curve b). Each of the curves is representative of some thirty discharge tubes. The curves show clearly the effect of the protective layer on the generation of light, namely a higher LO at zero hours and a smaller decrease in luminance during the active operating time of the lamp. The difference with regard to lumen value approaches 4% after 2000 hours and is calculated to increase to more than 8% within a period of 10,000 hours burning time. The use of a protective layer in accordance with the invention is particularly attractive from the aspect of lengthening the useful life span of such discharge tubes, (economic life span=27,000 hours).

The experimental support for the present invention is based on a large number of lamps manufactured over an extended period of time of manufacture. In each test series discharge tubes which were provided with a protective layer or barrier layer were mixed with tubes that were not provided with such a layer, so that lamp manufacturing conditions would be as uniform as possible.

According to the invention the protective layer comprises crystalline, fine-grain barium sulphate (grain size 30–220 nm, preferably 50–150 nm) or mixtures of such barium sulphate and amorphous, highly dispersed silicon dioxide (grain size 5–30 nm, preferably 10–20 nm) with a layer thickness (mass/surface unit) of 0.03–0.50 mg/cm$^2$, preferably 0.06–0.20 mg/cm$^2$).

The protective layer is applied to the glass surface of the discharge tube by wetting the inner surfaces of the tube with a well dispersed, stable barium sulphate aqueous suspension or an aqueous suspension of $(BaSO_4)_n$+-$(SiO_2)_m$ (n=0.1–0.9; m=1−n). The suspension is characterized in that at least 95% of the pigment is present as primary grains, and that the suspension remains stable for a long period of time, i.e. that the suspension has a low degree of reagglomeration. The suspension is first prepared in the form of a concentrate containing protective pigment, binder—such as APMA (=ammonium polymethyl acrylate), surface active substances and deionized or distilled water. The pigment is dispersed with the aid of a colloidal mixer to which a dispersing agent is supplied, for example nonylphenole-ethyleneoxide-condensate, preferably the condensate retailed under the tradename ETHYLAN-TU. The protective layer suspension is prepared from said concentrate, by diluting the concentrate with deionized water. Subsequent to allowing the suspension to run off the glass surface, the resultant protective layer is dried with hot air at a temperature of 60° C. The layer of luminescent powder is then applied.

The aforedescribed suspension provides, with the aid of a simple method of application, a coherent protective layer which is practically pore free and which adheres well to the glass surface of the discharge tube. The pigment, i.e. $BaSO_4$ or mixtures of $BaSO_4$ and $SiO_2$ is essentially fixated in the form of primary grains or particles. In the case of a layer thickness of 0.12 mg/cm$^2$ and a grain size of 50–100 nm, the grains are distributed in 30–60 layers, which together provide $10^{11}$–$10^{14}$ optical light-scattering centres per cm$^2$. The largest number of light-scattering centres ($>10^{13}$) exists when the layer has the molar composition $(BaSO_4)_{0.1}+(SiO_2)_{0.9}$.

As a result of its composition and dimensions, the proposed protective layer has, in addition to its protective function against reduction in lamp luminance, an optical effect which enhances the utility of the ultraviolet radiation necessary for light generation. The protective function of the protective layer can be divided into two categories:

1. mechanical barrier which prevents $Hg^*$, $Hg^{2+}$ and to a certain extent also ultraviolet radiation from reaching the glass surface of the discharge tube.

2. an optical barrier which remits the ultraviolet radiation and therewith minimizes the occurrence of photochemical reactions at the glass surface of the discharge tube.

The elevated emission of short wave radiation provided by the protective layer means that the excitation radiation is utilized more effectively as a result of multiple reflections in the luminescent powder layer. The remission characteristics of the layer can be described satisfactorily with the aid of Raleigh's equation for scattering radiation incident on a powder layer.

$$I = K \cdot I_0 \cdot \frac{V^2}{\lambda^4}$$

I=the intensity of scattered radiation
$I_0$=the intensity of incident radiation
V=particle volume
λ=the wavelength of incident radiation.

The percentage of radiation remitted changes with the relationship $1/\lambda^4$, i.e. with the fourth power of the wave-length. The remission thus becomes more pronounced the shorter the wavelength. This is advantageous with regard to radiation balance and provides the aforesaid optical protection to the glass discharge tube and results in a proportion of the excitation radiation being reflected back to the luminescent substance, enabling this radiation to be converted to visible light. FIG. 2 illustrates the ability of the protective layer to remit radiation of different wavelengths. The Raleigh equation can be applied to systems in which the diameter of the powder grains or particles is smaller than the wavelength of the radiation. This condition is fulfilled by the proposed, closely packed protective layer, the grain size distribution of which provides a very large number of light scattering centres per unit of surface area. When remission of the shortwave radiation is amplified, e.g., by a protective layer, the light yield of a lamp can be improved when 185 nm-radiation can be converted to visible light in addition to the main excitation radiation having a wavelength of 254 nm. The extent to which 185 nm and 254 nm radiation can be adsorbed by the luminescent substance depends on the remission spectrum of this substance in the ultraviolet range.

The now published investigations of the remission properties and excitation properties of various luminescent substances in shortwave ultraviolet light (<200 nm) show that 185 nm-radiation takes part in the light generation of certain luminescent powders. One example is the green-radiating component CAT ((Ce,Tb) Mg $A_{11}O_{19}$) in 3-band powder, which has a high degree of absorption and excitation extending over the whole ultraviolet range, from 185 to 300 nm. Since, e.g., the percentage of UV-185 nm in a 36 W discharge tube constitutes approximately 12% of the ultraviolet radiation, it is possible to increase the light yield of the lamp by several percent, through effective remission of the wavelength 185 nm and the wavelength 254 nm. This is primarily the case when the quantum exchange of the luminescent substance for UV-185 nm has a relatively high value, as in the case of CAT and certain halophosphates.

While the invention has been described in some detail above, it is to be understood that this detailed description is by way of example only, and that the protection granted is to be limited only by the spirit of the invention and the scope of the following claims.

I claim:

1. A glass envelope particularly adapted for use in a metal vapour gas discharge lamp, said lamp being of a type filled with a noble gas, comprising:

a glass envelope, a protective layer coating the inner surface of said glass envelope, a fluorescent substance coating over said protective layer coating, whereby said protective layer is between said glass envelope and fluorescent substance coating, and said protective layer comprising a mixture of barium sulphate and amorphous, highly dispersed silicon dioxide.

2. The envelope of claim 1, wherein said protective layer consists essentially of $(BaSO_4)_n+(SiO_2)_m$, and wherein $n=0.1–0.9$ and $m=1-n$ by molar composition.

3. The envelope of claim 1, wherein said barium sulphate is highly pure, crystalline and has a grain size of between 30 and 220 nanometers (nm).

4. The envelope of claim 3, wherein said barium sulphate grain size is between 50 and 150 nm.

5. The envelope of claim 1, wherein said silicon dioxide has a grain size of between 5 and 30 nm.

6. The envelope of claim 5, wherein said silicon dioxide grain size is between 10 and 20 nm.

7. The envelope of claim 1, wherein said protective layer has a thickness in the range of 0.03–0.50 $mg\times cm^{-2}$.

8. The envelope of claim 7, wherein said protective layer thickness is in the range of 0.06–0.20 $mg\times cm^{-2}$.

9. The envelope of claim 1, wherein at least 95% of the substance of said protective layer comprises primary grains.

10. The envelope of claim 1, wherein said mixture further comprises a binder for adhering said protective layer to said inner surface of said glass envelope, said binder comprising a substance which will prevent agglomeration.

11. The envelope of claim 10, wherein said binder comprises ammonium polymethyl acrylate.

* * * * *